US009695716B2

(12) United States Patent
Smith et al.

(10) Patent No.: US 9,695,716 B2
(45) Date of Patent: Jul. 4, 2017

(54) MULTI-MODE VARIABLE CAM TIMING PHASER

(71) Applicant: BorgWarner Inc., Auburn Hills, MI (US)

(72) Inventors: Franklin R. Smith, Cortland, NY (US); Brian T. Kenyon, Cayuta, NY (US)

(73) Assignee: BorgWarner Inc., Auburn Hills, MI (US)

( * ) Notice: Subject to any disclaimer, the term of this patent is extended or adjusted under 35 U.S.C. 154(b) by 121 days.

(21) Appl. No.: 14/840,683

(22) Filed: Aug. 31, 2015

(65) Prior Publication Data

US 2017/0058726 A1 Mar. 2, 2017

(51) Int. Cl.
*F01L 1/34* (2006.01)
*F01L 1/344* (2006.01)

(52) U.S. Cl.
CPC ... *F01L 1/3442* (2013.01); *F01L 2001/34426* (2013.01)

(58) Field of Classification Search
CPC ..... F01L 1/3442
USPC ..... 123/90.17
See application file for complete search history.

(56) References Cited

U.S. PATENT DOCUMENTS 6,453,859 B1 9/2002 Smith et al.
7,434,554 B2 * 10/2008 Nagashima ..... F01L 1/3442 123/90.15
7,946,266 B2 5/2011 Knecht et al.

* cited by examiner

*Primary Examiner* — Zelalem Eshete
(74) *Attorney, Agent, or Firm* — Brown & Michaels, PC

(57) ABSTRACT

A variable camshaft timing device can operate using pressure generated by camshaft torque energy to transfer fluid from one working chamber to another work chamber or operate via an external fluid pressure source to fill one working chamber while simultaneously exhausting an opposing working chamber or operate using both modes simultaneously. The mode of the variable camshaft timing device is determined by the position of the control valve. The lock pin is controlled by fluid from one of the working chambers.

9 Claims, 16 Drawing Sheets

MULTI-MODE VARIABLE CAM TIMING PHASER

BACKGROUND OF THE INVENTION

Field of the Invention

The invention pertains to the field of variable cam timing phasers. More particularly, the invention pertains to a multi-mode variable cam timing phaser.

Description of Related Art

It has been demonstrated that operating a variable camshaft timing device phaser utilizing the camshaft torque energy to phase the valve timing device is desirable because of the low amount of fluid required by a camshaft torque actuated variable camshaft timing device. However, not all engines provide enough camshaft torque energy throughout the entire engine operating range to effectively phase the variable camshaft timing device.

BorgWarner's U.S. Pat. No. 6,453,859 discloses a phaser that uses cam torque and oil pressure to move the phaser. The phaser has a single recirculating check valve that either recirculates fluid to the advance port or the retard port. The single recirculating check valve is located downstream of the control valve and not connected directly to the advance and retard chambers.

Hilite's U.S. Pat. No. 7,946,266 discloses another phaser that uses cam torque and pressure to move the phaser. The phaser has two recirculating check valves prior to exhaust fluid entering the control valve or upstream of the control valve. A recirculating check valve is required for each set of chambers—advance and retard.

SUMMARY OF THE INVENTION

In one embodiment, a variable camshaft timing device can operate using pressure generated by camshaft torque energy to transfer fluid from one working chamber to another work chamber or operate via an external fluid pressure source to fill one working chamber while simultaneously exhausting an opposing working chamber or operate using both modes simultaneously. The mode of the variable camshaft timing device is determined by the position of the control valve. In this embodiment, the lock pin is controlled by fluid from one of the working chambers.

In another embodiment, a variable camshaft timing device uses camshaft torque energy to transfer fluid from one working chamber to another work chamber and selectively receive makeup fluid from a supply during recirculation. In this embodiment the lock pin is controlled by spool position.

DETAILED DESCRIPTION OF THE INVENTION

Figure 1:
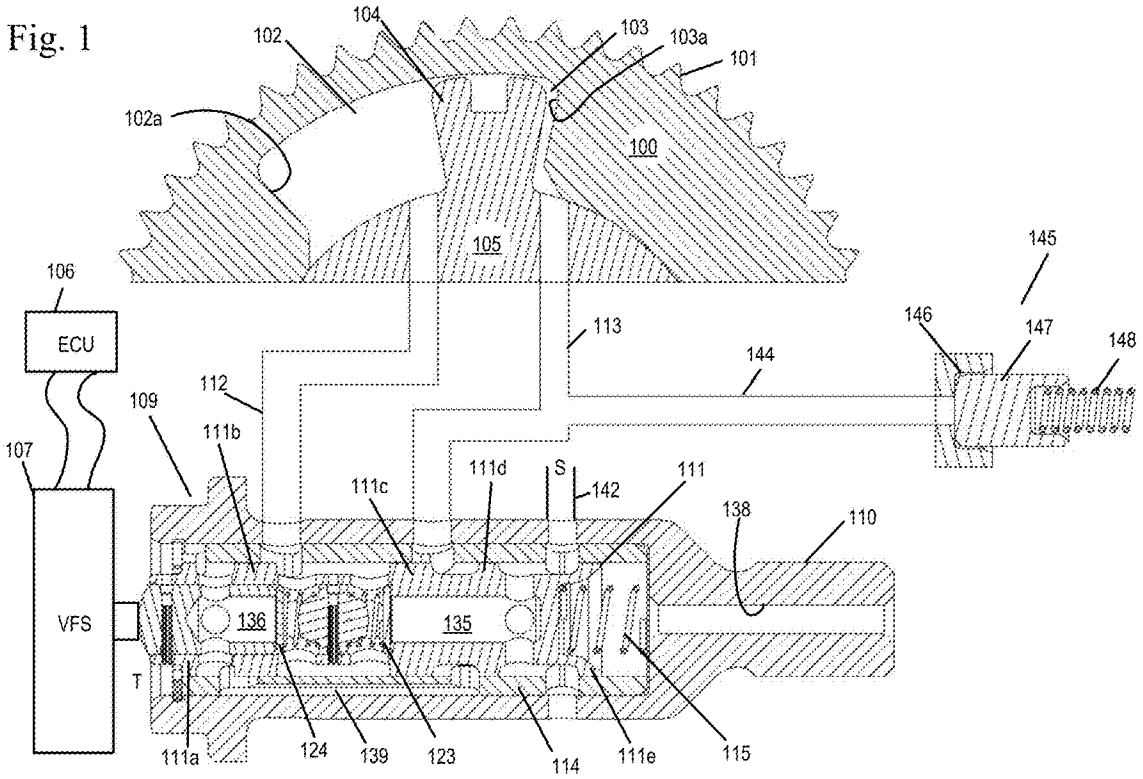
FIG. 1 shows a schematic of a variable cam timing phaser operating in a first state or mode.

In an embodiment of the present invention, the control valve may direct fluid to exhaust from a working chamber to either a path through a recirculation check valve internal to the phaser leading to another chamber or to a path that exhausts fluid back to tank or sump or to do both simultaneously.

In the present invention, it is recognized that a single recirculation check valve and a single inlet check valve are used to accomplish multi-modes. Furthermore, the recirculation check valve and the inlet check valve are located internal to the control valve, which may reduce the radial package size.

The single inlet check valve and the single recirculation check valve may be the same type of check valve (plate type, ball type or disc type) or they may be different types of check valves.

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). As shown in the figures, vane phasers have a rotor assembly 105 with one or more vanes 104, mounted to the end of the camshaft, surrounded by a housing assembly 100 with the vane chambers into which the vanes fit. It is possible to have the vanes 104 mounted to the housing assembly 100, and the chambers in the rotor assembly 105, as well. The housing's outer circumference 101 forms the sprocket, pulley or gear accepting drive force through a chain, belt, or gears, usually from the crankshaft, or possible from another camshaft in a multiple-cam engine.

The housing assembly 100 of the phaser has an outer circumference 101 for accepting drive force. The rotor assembly 105 is connected to the camshaft (not shown) and is coaxially located within the housing assembly 100. The rotor assembly 105 has a vane 104 separating a chamber formed between the housing assembly 100 and the rotor assembly 105 into an advance chamber 102 and a retard chamber 103. The vane 104 is capable of rotation to shift the relative angular position of the housing assembly 100 and the rotor assembly 105. While only one advance chamber and one retard chamber are shown, multiple chambers may be present. Furthermore, in a phaser at least one set of advance and retard chambers are working or actively receiving or exhausting fluid and moving the vane 104.

A lock pin assembly 145 is present within the phaser. A lock pin 147 is slideably housed in a bore in the rotor assembly 105 and has an end portion that is biased towards and fits into a recess 146 in the housing assembly 100 by a spring 148. Alternatively, the lock pin 147 may be housed in the housing assembly 100 and be spring 148 biased towards a recess 146 in the rotor assembly 105. The engagement and disengagement of the lock pin 147 with the recess 146 is controlled by fluid in the retard chamber 103 and the position of the spool 111. Alternatively, the engagement and disengagement of the lock pin 147 with the recess 146 is controlled by fluid in the advance chamber 102 and the position of the spool 111.

A control valve 109, preferably a spool valve, includes a spool 111 with cylindrical lands 111*a*, 111*b*, 111*c*, 111*d*, 111*e* slideably received in a sleeve 114 within a bore 108 of a center bolt 110. The sleeve 114 has a plurality of ports 125, 126, 127, 129 and a recess 128 which connects ports 126 and 129. The recess 128 forms a passage 139 for fluid to flow with the bore 108 of the center bolt 110.

The center bolt 110 is preferably received by the camshaft (not shown). The center bolt 110 has a port 120 connected to the advance chamber 102 and in fluid communication with port 125 of the sleeve 114, a port 121 connected to the retard chamber 103 and in fluid communication with port 126 of the sleeve 114 and a port 122 connected to the supply 142 and in fluid communication with port 127 of the sleeve 114.

The spool 111 has a central passage which is divided into a working central passage 136 and an inlet central passage 135 by a recirculation check valve 124 and an inlet check valve 123. The recirculation check valve 124 includes a plug 140, a plate 117, and a spring 116, with the first end of the spring 116 contacting the plug 140 and the second end contacting the plate 117. The inlet check valve 123 includes a plug 140, a plate 119, and a spring 118, with the first end of the spring 118 contacting the plug 140 and the second end contacting the plate 119. Between the first land 111*a* and the second land 111*b* is an opening 130 leading to the working central passage 136. Between the second land 111*b* and the third land 111*c* are two openings, with one of the openings 131 leading to the recirculation check valve 124 and the other opening 132 leading to the inlet check valve 123. Between the third land 111*c* and the fourth land 111*d* is an annular groove 133. Between the fourth land 111*d* and the fifth land 111*e* is an opening 134 leading to inlet central passage 135.

One end of the spool 111 contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The position of the control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 111 is influenced by spring 115 and the solenoid 107 controlled by the ECU 106. Further detail regarding control of the phaser is discussed in detail below. The position of the spool 111 controls the mode or state of the phaser as well as whether the lock pin 147 is engaged or disengaged. The control valve 109 has five modes. A first mode in which the spool 111 is positioned such that the vane 104 is moved by both cam torque actuation and torsion assist in the advance direction. A second mode in which the spool 111 is positioned such that the vane 104 is cam torque actuated in the advance direction. A third mode in which the spool 111 is positioned such that the vane 104 is held in position. A fourth mode in which the spool 111 is positioned such that the vane 104 is cam torque actuated in the retard direction and a fifth mode in which the spool 111 is positioned such that the vane 104 is moved by both cam torque actuation and torsion assist in the retard direction.

Cam torque actuation of a variable camshaft timing (VCT) of a phaser uses torque reversals in the camshaft caused by the forces of opening and closing engine valves to move the vane 104. The advance and retard chambers 102, 103 are arranged to resist positive and negative torque pulses in the camshaft (not shown) and are alternatively pressurized by the cam torque. The control valve 109 allows the vane 104 in the phaser to move by permitting fluid flow from the advance chamber 102 to the retard chamber 103 or vice versa, depending on the desired direction of movement.

Apart from the camshaft torque actuated (CTA) variable camshaft timing (VCT) systems, the majority of hydraulic VCT systems operate under two principles, oil pressure actuation (OPA) or torsional assist (TA). In the oil pressure actuated VCT systems, an oil control valve (OCV) directs engine oil pressure to one working chamber in the VCT phaser while simultaneously venting the opposing working chamber defined by the housing assembly, the rotor assembly, and the vane. This creates a pressure differential across one or more of the vanes to hydraulically push the VCT phaser in one direction or the other. Neutralizing or moving the valve to a null position puts equal pressure on opposite sides of the vane and holds the phaser in any intermediate position. If the phaser is moving in a direction such that valves will open or close sooner, the phaser is said to be advancing and if the phaser is moving in a direction such that valves will open or close later, the phaser is said to be retarding.

The torsional assist (TA) systems operates under a similar principle to the OPA system with the exception that it has one or more check valves to prevent the VCT phaser from moving in a direction opposite than being commanded, should it incur an opposing force such as a torque impulse caused by cam operation.

FIGS. 1-10 show operating modes of a multi-mode VCT phaser depending on the spool valve position. The positions shown in the figures define the direction the VCT phaser is moving. It is understood that the phase control valve has an infinite number of intermediate positions, so that the control valve not only controls the direction the VCT phaser moves but, depending on the discrete spool position, controls the rate at which the VCT phaser changes positions. Therefore, it is understood that the phase control valve can also operate in infinite intermediate positions and is not limited to the positions shown in the Figures.

In the first mode, the spool 111 of the control valve 109 is moved to a position so that fluid may flow from the retard chamber 103, through the spool 111 and the recirculation check valve 124 within the spool 111, to the advance chamber 102. Fluid from the retard chamber 103 may also flow out of the spool 111 to tank T. Fluid from a supply S provides fluid to the advance chamber 102 through the spool 111 and the inlet check valve 123 within the spool 111. Fluid from supply S is prevented from flowing to tank T by the spool 111. The lock pin 147 is engaged with the recess 146 or is locked.

In the second mode, the spool 111 of the control valve 109 is moved to a position so that fluid may flow from the retard chamber 103 through the spool 111 and the recirculation check valve 124 within the spool, to the advance chamber 102. Fluid is blocked from exiting the advance chamber 102. Fluid from a supply S provides makeup fluid only to the advance chamber 102 through the spool 111 and the inlet check valve 123 within the spool 111. Fluid from supply S and the advance chamber 102 is prevented from flowing to tank T by the spool 111. The lock pin 147 does not engage the recess 146 or is unlocked.

In a third mode, the spool 111 is moved to a position that blocks the exit of fluid from the advance and retard chambers 102, 103, but a small amount of fluid from supply S is able to enter the advance and retard chambers 102, 103 through the spool 111. The lock pin 147 is disengaged from the recess 146 or is unlocked.

In the fourth mode, the spool 111 is moved to a position so that fluid may flow from the advance chamber 102 through the spool 111 and the recirculation check valve 124 within the spool, to the retard chamber 103. Fluid is blocked from exiting the retard chamber 103. Fluid from a supply S provides fluid to the retard chamber 103 through the spool 111 and the inlet check valve 123 within the spool 111. Fluid from supply S is prevented from flowing to tank T by the spool 111. The lock pin 147 is disengaged from the recess 146 or is unlocked.

In a fifth mode, the spool 111 is moved to a position so that fluid may flow from the advance chamber 102, through the spool 111 and the recirculation check valve 124 within the spool 111, to the retard chamber 103. Fluid from the advance chamber 102 may also flow out of the spool 111 to tank T. Fluid from a supply S provides fluid to the retard chamber 103 through the spool 111 and the inlet check valve 123 within the spool 111. Fluid from the supply S and the retard chamber 103 is prevented from flowing to tank T by the spool 111. The lock pin 147 is disengaged from the recess 146 or is unlocked.

Based on the duty cycle of the pulse width modulated variable force solenoid 107, the spool 111 moves to a corresponding position along its stroke, for example 0 mm stroke, 1 mm stroke, 2.5 mm stroke, 4 mm stroke, and 5 mm stroke. The duty cycle of the variable force solenoid 107 is varied to correspond to the specific position along its stroke.

Figure 6:
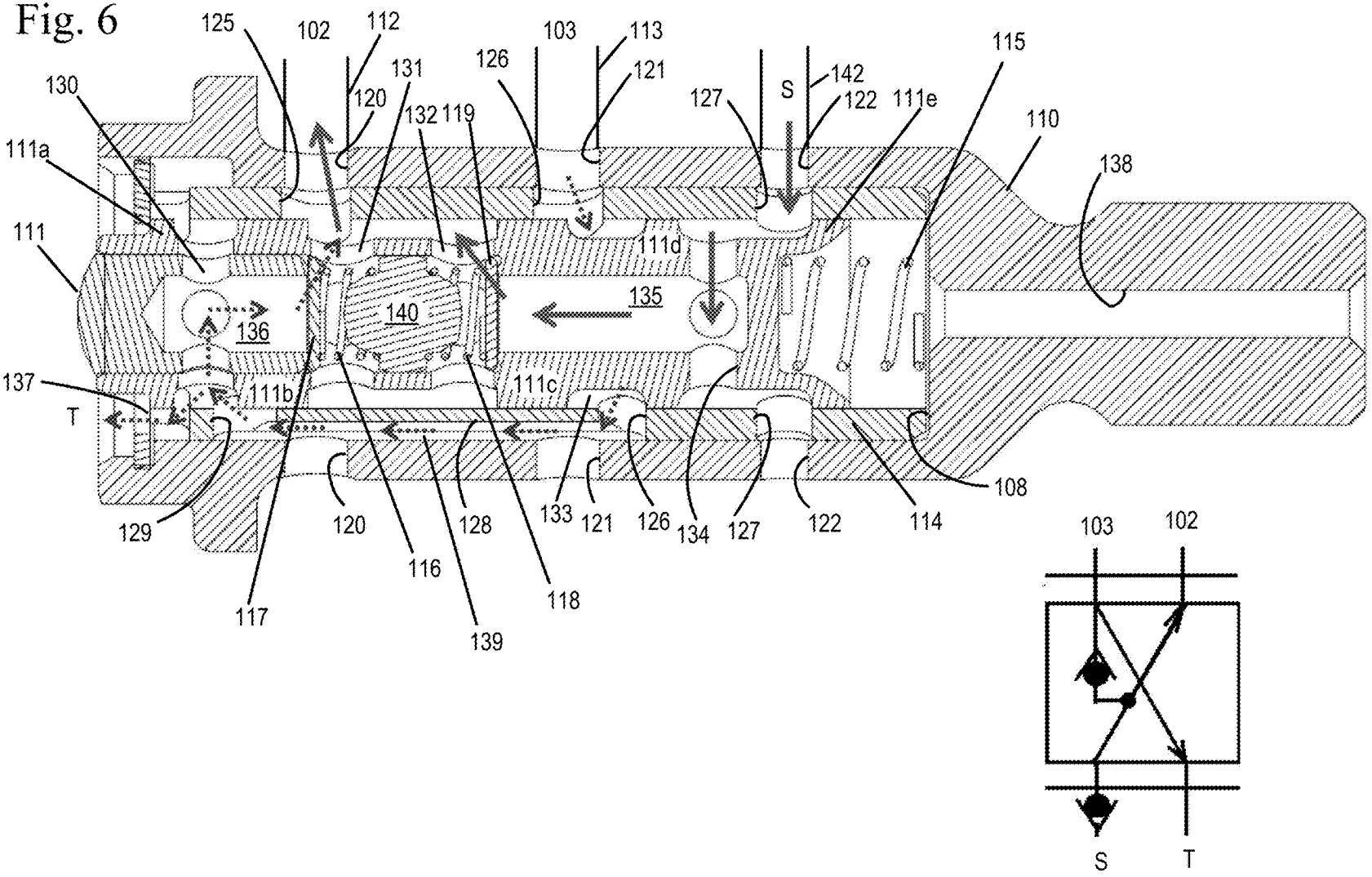
FIG. 6 shows a close-up of the control valve of the phaser operating in the first mode.

Referring to FIGS. 1 and 6, the phaser moving towards the advance position. To move towards the advance position, the duty cycle of the VFS 107 is such that the stroke of the spool 111 is 0 mm and the spool 111 is moved by the force of the spring 115 until the force of the spring 115 balances the force of the VFS 107.

Camshaft torque pressurizes the retard chamber 103, causing fluid to move from the retard chamber 103 and into the advance chamber 102, and the vane 104 to move towards the retard wall 103*a*.

With the position of the spool 111 in the first mode, fluid from the retard chamber 103 or opposing chamber (indicated by a dashed line in FIG. 6) flows through line 113 to the control valve 109. From line 113, fluid flows into the control valve 109 through port 121 of the center bolt 110 and port 126 of the sleeve 114. From port 126, fluid flows around the annular groove 133 between spool lands 111*c* and 111*d* to the recess 128 and the passage 139 formed between the sleeve 114 and the center bolt 110.

From the passage 139, fluid can flow to both tank T and the advance chamber 102. The fluid flowing to tank T, flows from the passage 139, through port 129 of the sleeve 114 and out through a passage 137 formed between the spool 111, the sleeve 114, and the center bolt 110.

The fluid flowing to the advance chamber or working chamber 102 in this mode, flows from the passage 139, through port 129 of the sleeve 114 through an opening 130 between spool land 111*a* and 111*b* to a working central passage 136. The pressure of the fluid from the retard chamber 103 on the plate 117 is great enough to overcome the force of the spring 116 of the recirculation check valve 124 and flow out to the advance chamber 102 through opening 131 between spool lands 111*b* and 111*c* and through ports 125 and 120 in fluid communication with the advance chamber 102.

Fluid is also supplied to the advance chamber 102 from a supply S. The supply S is in fluid communication with the ports 122 and 127 through supply line 142 (indicated by the solid line in FIG. 6). Fluid flows from the ports 122 and 127 to an opening 134 in the spool between spool lands 111*d* and 111*e*. From the opening 134, fluid flows to the inlet central passage 135 of the spool 111. The pressure of the fluid from supply S on the plate 119 is great enough to overcome the force of the spring 118 of the inlet check valve 123 and flow out to the advance chamber 102 through opening 132 between spool lands 111*b* and 111*c* and through ports 125 and 120 in fluid communication with the advance chamber 102.

Therefore, when the control valve 109 and the phaser are in this first mode, both cam torque actuation (fluid is recirculated from the retard chamber 103 to the advance chamber 102 through recirculation check valve 124) and torsion assist (fluid from supply S flows to the advance chamber 102 through an inlet check valve 123 and draining of fluid from the retard chamber to tank T) are simultaneously used to move the vane 104.

Since fluid from the retard chamber 103 is draining and recirculated to the advance chamber 102, the pressure of the fluid on the lock pin 147 is not great enough to overcome the force of the lock pin spring 148, and the lock pin 147 engages the recess 146, locking the housing assembly 101 relative to the rotor assembly 105.

Figure 2:
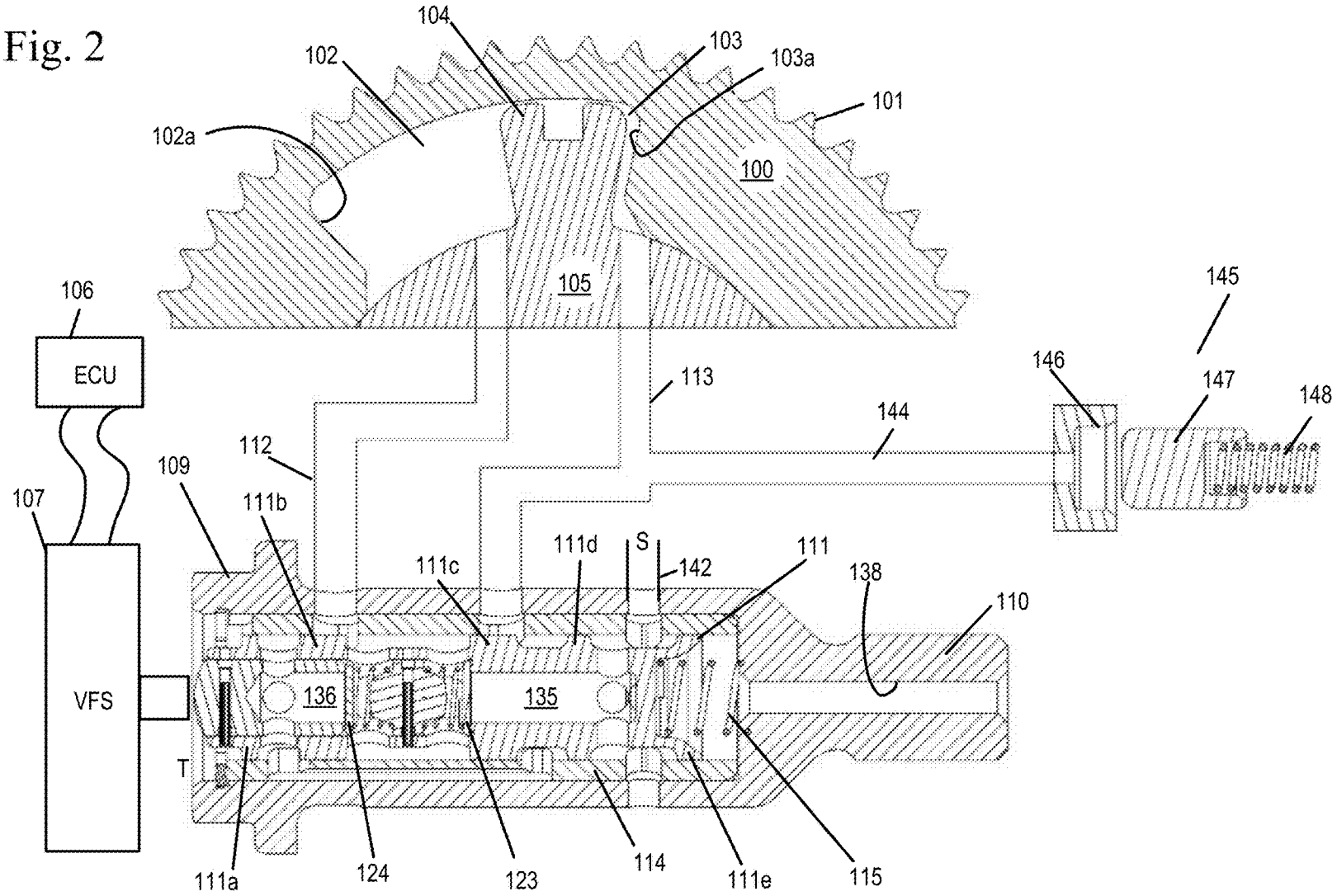
FIG. 2 shows a schematic of a variable cam timing phaser operating in a second state or mode.
Figure 7:
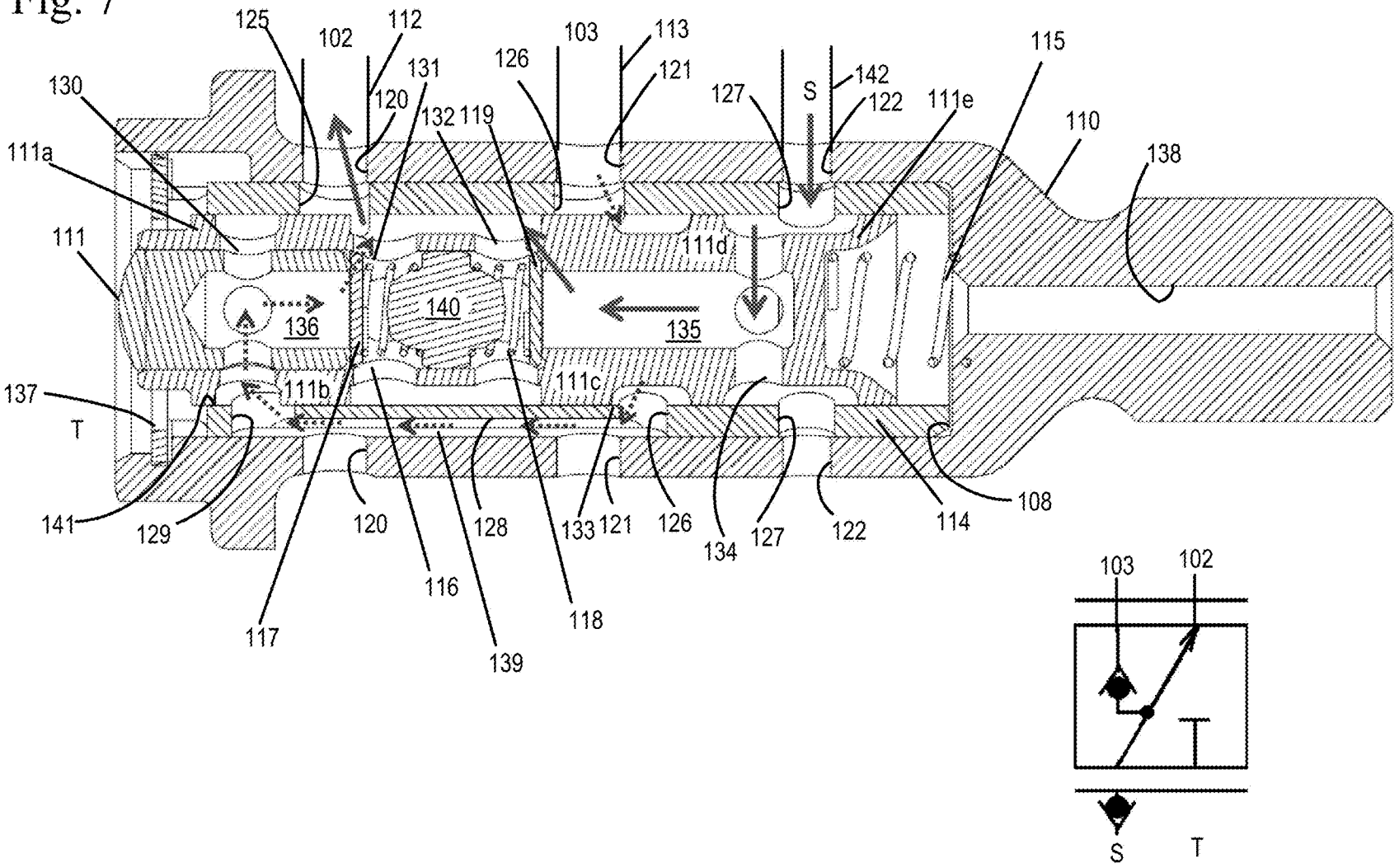
FIG. 7 shows close-up of the control valve of the phaser operating in the second mode.

FIG. 2 shows the phaser moving towards the advance position and FIG. 7 shows a close up of the fluid flow through the control valve. To move towards the advance position, the duty cycle of the VFS 107 is such that the stroke of the spool 111 is 1 mm and the spool 111 is moved by the force of the VFS 107 until the force of the spring 115 balances the force of the VFS 107.

Camshaft torque pressurizes the retard chamber 103, causing fluid to move from the retard chamber 103 and into the advance chamber 102, and the vane 104 to move towards the retard wall 103*a*.

With the position of the spool 111 of the control valve 109 in the second mode, fluid from the retard chamber 103 (indicated by a dashed line in FIG. 6) flows through line 113 to the control valve 109. From line 113, fluid flows into the control valve through port 121 of the center bolt 110 and port 126 of the sleeve 114. From port 126, fluid flows around the annular groove 133 between spool lands 111*c* and 111*d* to the recess 128 and the passage 139 formed between the sleeve 114 and the center bolt 110. From the passage 139, fluid can only recirculate to the advance chamber 102. Unlike in the first mode, fluid is prevented from venting to tank T by the interface 141 of spool land 111*a* and the sleeve 114.

The fluid flowing to the advance chamber 102, flows from the passage 139, through port 129 of the sleeve 114 through an opening 130 between spool land 111*a* and 111*b* to a working central passage 136. The pressure of the fluid from the retard chamber 103 on the plate 117 is great enough to overcome the force of the spring 116 of the recirculation check valve 124 and flow out to the advance chamber 102 through opening 116 between spool lands 111*b* and 111*c* and through ports 125 and 120 in fluid communication with the advance chamber 102.

Fluid is also supplied to the advance chamber 102 from a supply S to make up for leakage and is not used to move the vane 104. The supply S is in fluid communication with the ports 122 and 127 through supply line 142 (indicated by the solid line in FIG. 6). Fluid flows from the ports 122 and 127 to an opening 134 in the spool between spool lands 111*d* and 111*e*. From the opening 134, fluid flows to the inlet central passage 135 of the spool 111. The pressure of the fluid from supply S on the plate 119 is great enough to overcome the force of the spring 118 of the inlet check valve 123 and flow out to the advance chamber 102 through opening 118 between spool lands 111*b* and 111*c* and through ports 125 and 120 in fluid communication with the advance chamber 102.

Therefore, when the control valve 109 and the phaser are in this second mode, only cam torque actuation (fluid is recirculated from the retard chamber 103 to the advance chamber 102 through recirculation check valve 124) is used to move the vane 104. Fluid is not vented from the system. Fluid provided from supply is used to make up for leakage. When cam torque energy reverses, both the inlet check valve 123 and the recirculation check valve 124 prevent fluid from leaving the advance chamber 102 or working chamber.

Since fluid from the retard chamber 103 is draining and recirculated to the advance chamber, but not venting to sump or atmosphere, the pressure of the fluid on the lock pin 147 is great enough to overcome the force of the lock pin spring 148 while actuating, and the lock pin 147 remains disengaged from the recess 146, and is therefore unlocked.

Figure 3:
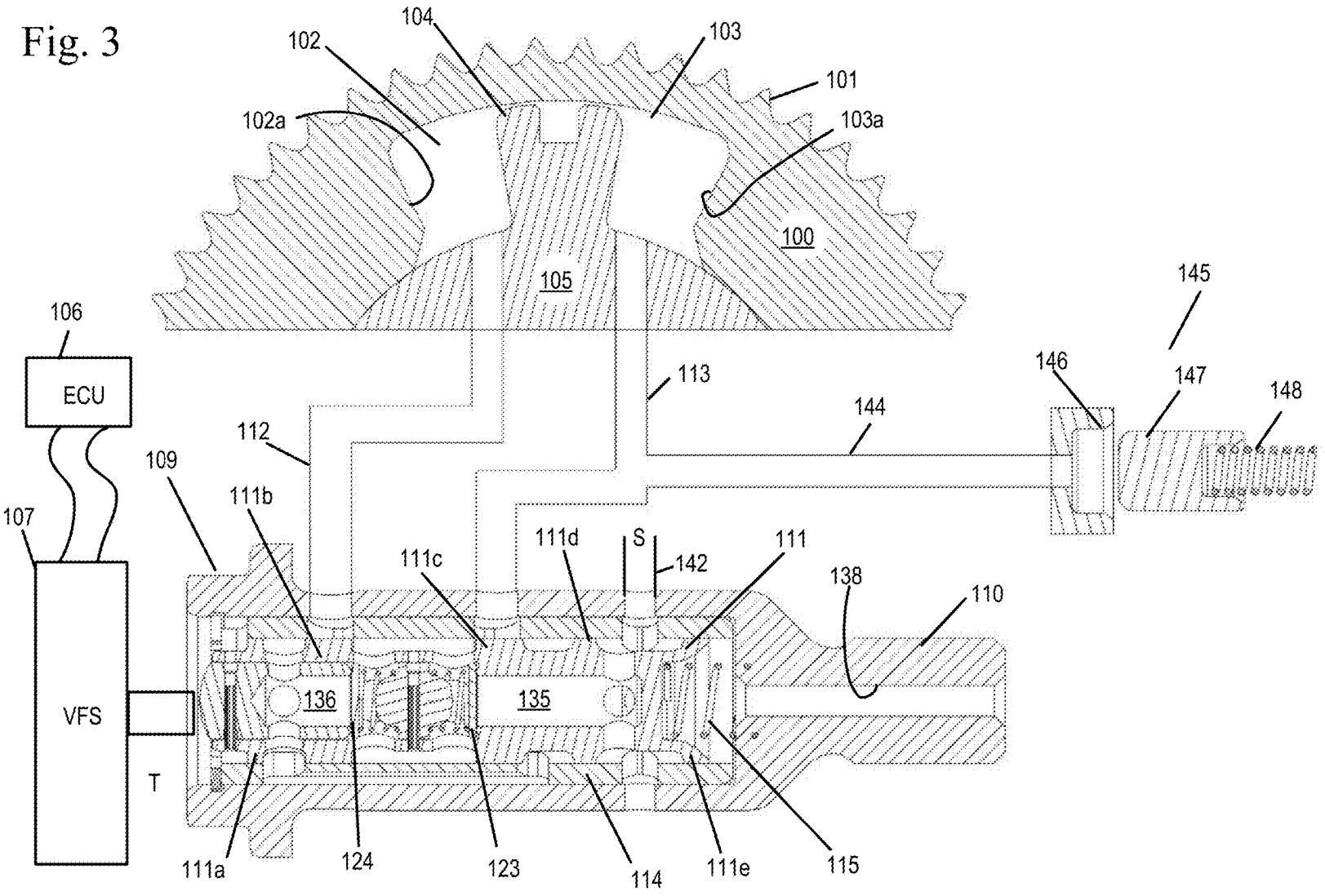
FIG. 3 shows a schematic of a variable cam timing phaser operating in a third state or mode.
Figure 8:
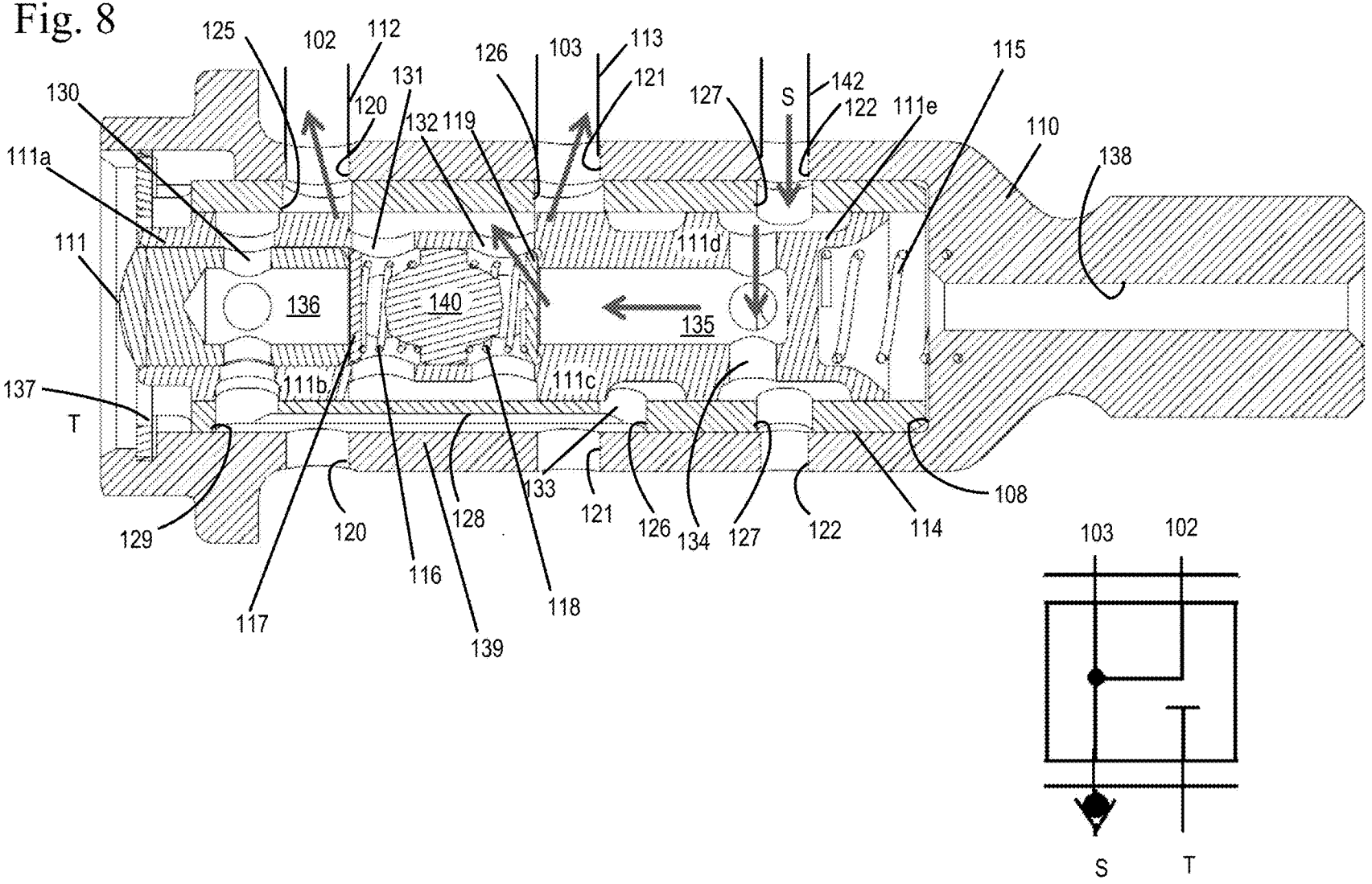
FIG. 8 shows close-up of the control valve of the phaser operating in the third mode.

FIG. 3 shows the phaser in the null position and FIG. 8 shows a close up of the fluid flow through the control valve. In this position, the duty cycle of the variable force solenoid 107 is such that stroke of the spool is 3 mm. The force of the VFS 107 on one end of the spool 111 equals the force of the spring 115 on the opposite end of the spool 111 in null position.

With the position of the spool in the third mode, fluid from the supply S is provided to the inlet central passage 135 of the spool 111 through a port 122 of the central bolt 110 and a port 127 of the sleeve 110. From the central passage 135, make up fluid is provided to the advance and retard chambers 102, 103 through the inlet check valve 123. While the spool valve lands 111*b* and 111*c* appear to completely block off passage from the openings 116 and 118 to the ports 120, 125, 126, 121 leading to the advance and retard chambers 102, 103, there is a small undercut or gap to allow fluid to flow to the advance and retard chambers 102, 103.

Since fluid is present in the retard chamber 103 and being provided to the retard chamber 103, the pressure of the fluid on the lock pin 147 is greater than the force of the lock pin spring 148, the lock pin 147 disengages the recess 146 and allowing the rotor assembly 105 to move relative to the housing assembly 101.

Figure 4:
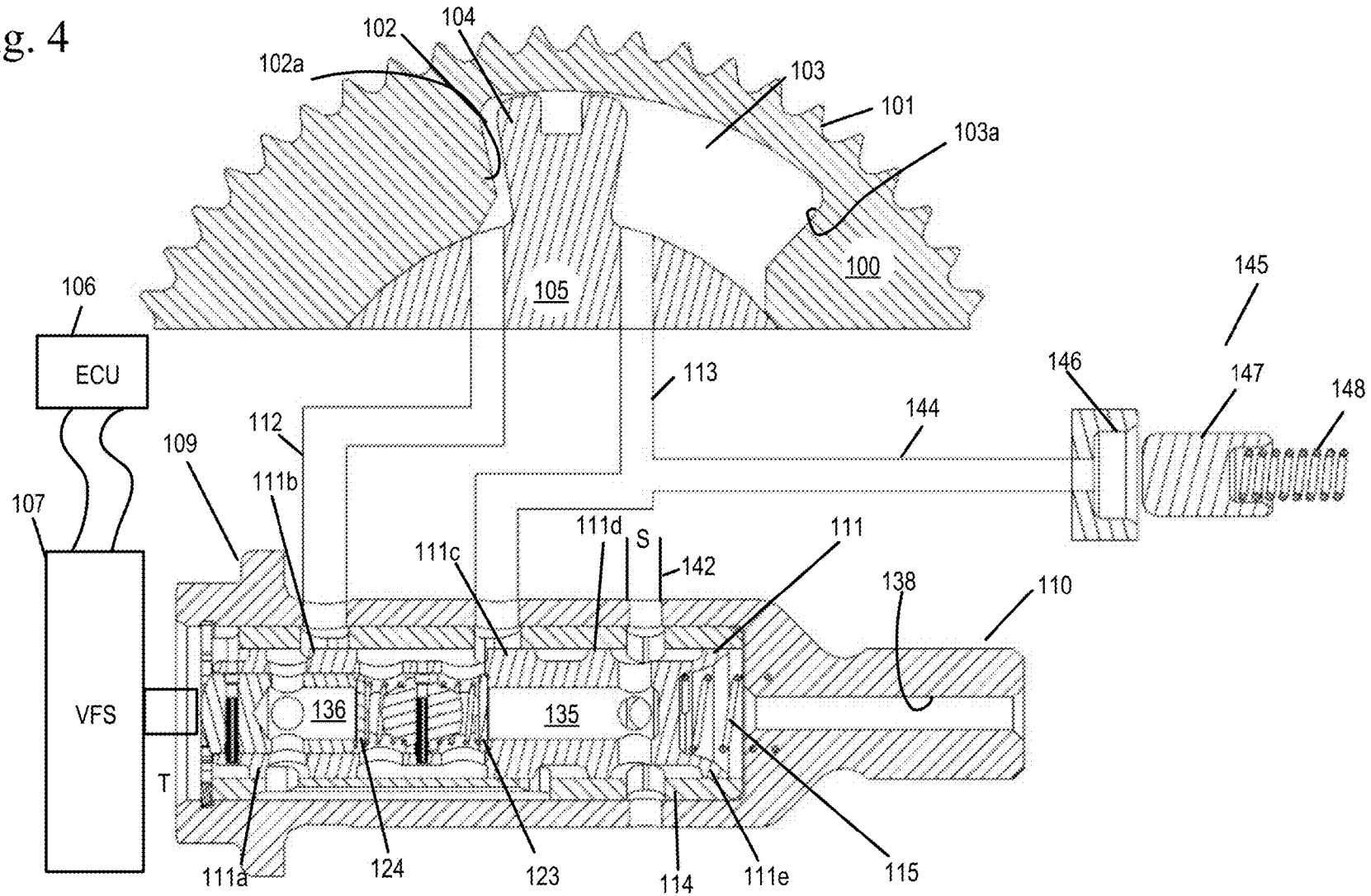
FIG. 4 shows a schematic of a variable cam timing phaser operating in a fourth state or mode.
Figure 9:
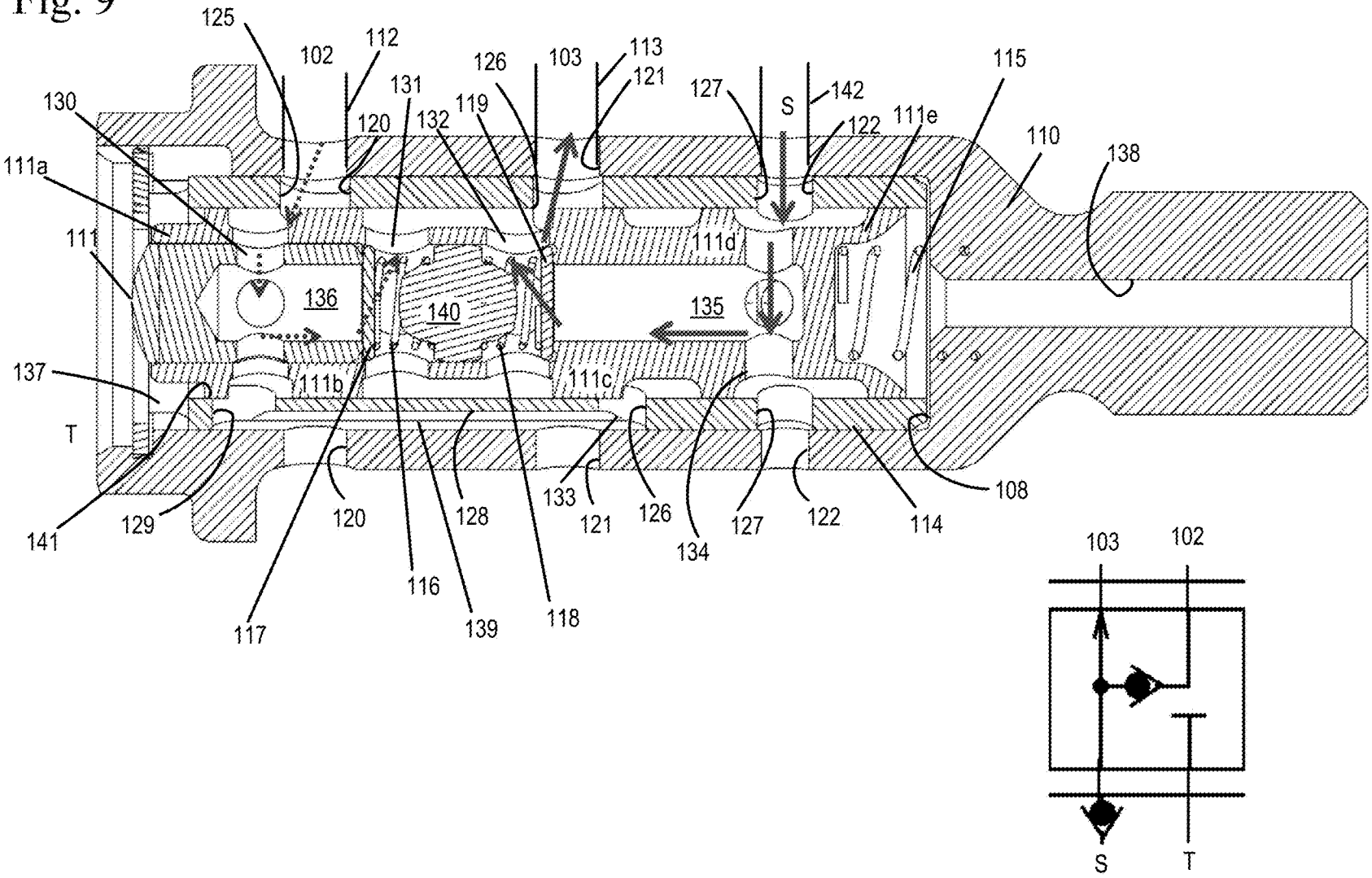
FIG. 9 shows a close-up of the control valve of the phaser operating in the fourth mode.

FIG. 4 shows the phaser moving towards the retard position and FIG. 9 shows a close up of the fluid flow through the control valve. To move towards the retard position, the duty cycle of the VFS 107 is such that the stroke of the spool 111 is 4 mm and the spool 111 is moved by the force of the VFS 107 until the force of the spring 115 balances the force of the VFS 111.

Camshaft torque pressurizes the retard chamber 103, causing fluid to move from the advance chamber 102 and into the retard chamber 103, and the vane 104 to move towards the advance wall 102*a*.

With the position of the spool in the fourth mode, fluid from the advance chamber 102 (indicated by a dashed line in FIG. 9) flows through line 112 to the control valve 109. From line 112, fluid flows into the control valve 109 through port 120 of the center bolt 110 and port 125 of the sleeve 114. From port 125, fluid flows through port 130 to working central passage 136. The pressure of the fluid from the advance chamber 102 on the plate 117 is great enough to overcome the force of the spring 116 of the recirculation check valve 124 and flow out to the retard chamber 103 through opening 116 between spool lands 111*b* and 111*c* and through ports 126 and 121 in fluid communication with the retard chamber 103. Fluid can only recirculate from the advance chamber 102 to the retard chamber 103. Fluid is prevented from venting to tank T by the interface 141 of spool land 111*a* and the sleeve 114. Any fluid that flows into passage 139 is blocked from reaching retard chamber 103 by spool lands 111*c* and 111*d*.

Fluid is also supplied to the retard chamber 103 from a supply S to make up for leakage and is not used to move the vane 104. The supply S is in fluid communication with the ports 122 and 127 through supply line 142 (indicated by the solid line in FIG. 9). Fluid flows from the ports 122 and 127 to an opening 134 in the spool between spool lands 111*d* and 111*e*. From the opening 134, fluid flows to the inlet central passage 135 of the spool 111. The pressure of the fluid from supply S on the plate 119 is great enough to overcome the force of the spring 118 of the inlet check valve 123 and flow out to the retard chamber 103 through opening 118 between spool lands 111*b* and 111*c* and through ports 126 and 121 in fluid communication with the retard chamber 103.

Therefore, when the control valve 109 and the phaser are in this fourth mode, only cam torque actuation (fluid is recirculated from the advance chamber 102 to the retard chamber 103 through recirculation check valve 124) is used to move the vane 104. Fluid is not vented from the system. Fluid provided from supply S is used to make up for leakage. When cam torque energy reverses, both the inlet check valve 123 and the recirculation check valve 124 prevent fluid from leaving the retard chamber 103 or working chamber.

Since fluid is being supplied to the retard chamber 103 by the advance chamber through recirculation, the pressure of the fluid on the lock pin 147 is great enough to overcome the force of the lock pin spring 148, and the lock pin 147 disengages the recess 146, allowing the housing assembly 101 to move relative to the rotor assembly 105.

Figure 5:
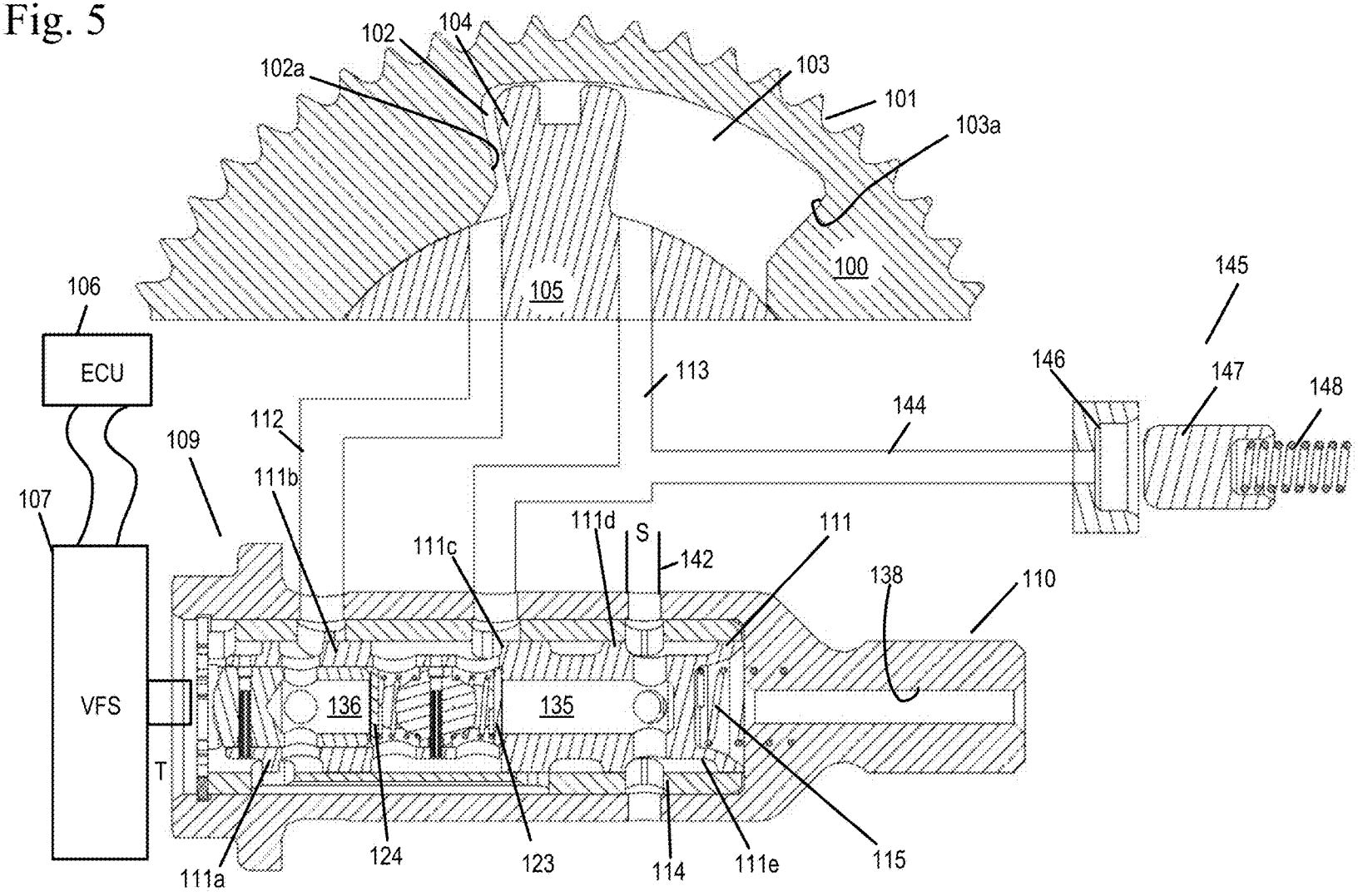
FIG. 5 shows a schematic of a variable cam timing phaser operating in a fifth state or mode.
Figure 10:
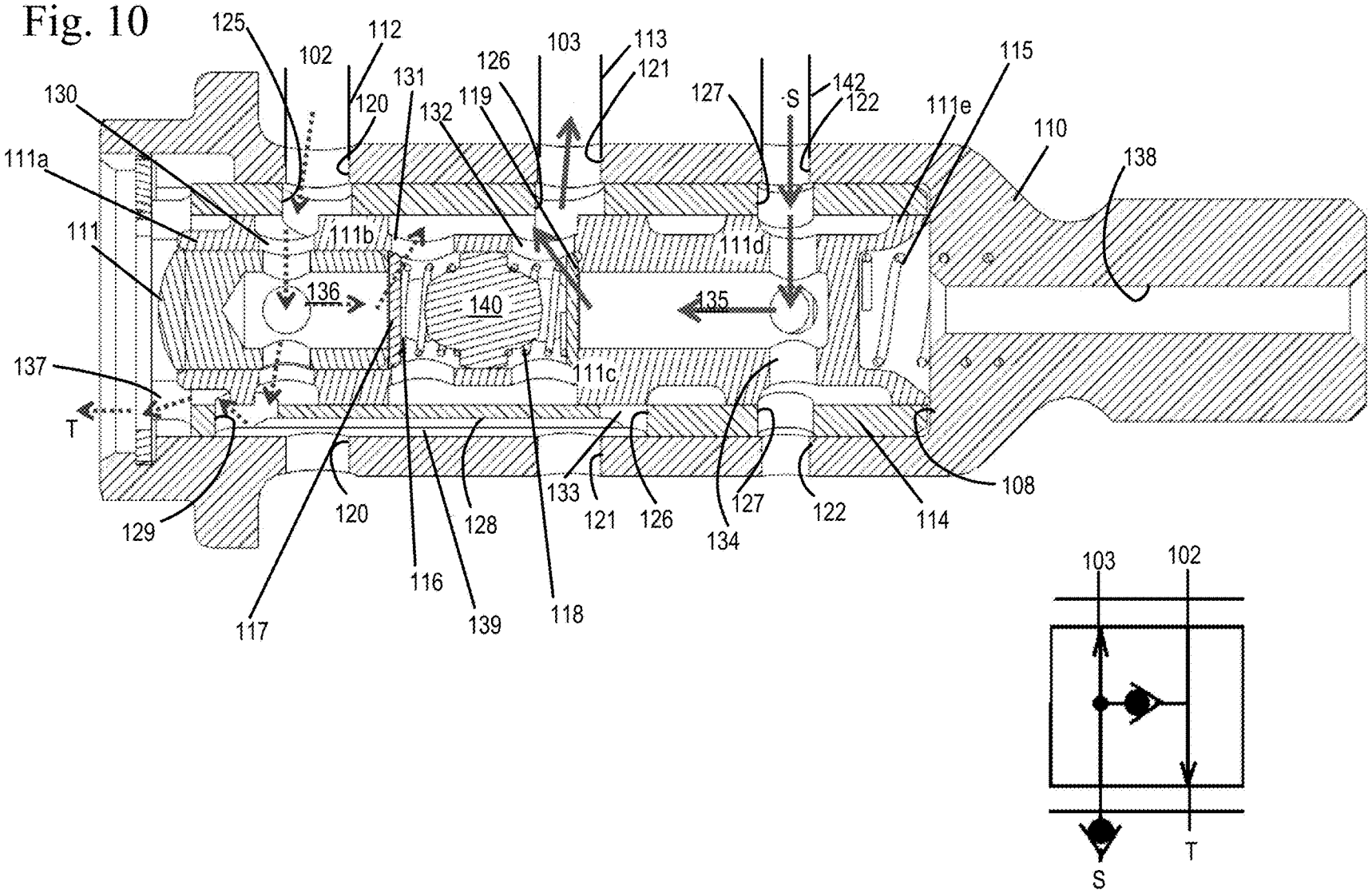
FIG. 10 shows a close-up of the control valve of the phaser operating in a fifth mode

FIG. 5 shows the phaser moving towards the retard position and FIG. 10 shows a close up of the fluid flow through the control valve. To move towards the retard position, the duty cycle of the VFS 107 is such that the stroke of the spool 111 is 5 mm and the spool 111 is moved by the force of the spring 115 until the force of the spring 115 balances the force of the VFS 111.

Camshaft torque pressurizes the advance chamber 102, causing fluid to move from the advance chamber 102 to the retard chamber 103, and the vane 104 to move towards the advance wall 102*a*.

With the position of the spool 111 in the fifth mode, fluid from the advance chamber 102 or opposing chamber (indicated by a dashed line in FIG. 10) flows through line 112 to the control valve 109. From line 112, fluid flows into the control valve 109 through port 120 of the center bolt 110 and port 125 of the sleeve 114. From port 125, fluid flows through port 130 to working central passage 136. The pressure of the fluid from the advance chamber 102 on the plate 117 is great enough to overcome the force of the spring 116 of the recirculation check valve 124 and flow out to the retard chamber 103 through opening 116 between spool lands 111*b* and 111*c* and through ports 126 and 121 in fluid communication with the retard chamber 103.

From the working central passage 136, fluid can also flow to passage 137 through opening 130 into port 129 of the sleeve 114. From port 129, fluid flows to tank T through passage 137, with passage 137 being defined between spool land 111*a* and sleeve land 111*a*. Any fluid that flows into passage 139 is blocked from reaching retard chamber 103 by spool lands 111*c* and 111*d*.

Fluid is also supplied to the retard chamber 103 from a supply S to make up for leakage and is not used to move the vane 104. The supply S is in fluid communication with the ports 122 and 127 through supply line 142 (indicated by the solid line in FIG. 9). Fluid flows from the ports 122 and 127 to an opening 134 in the spool between spool lands 111*d* and 111*e*. From the opening 134, fluid flows to the inlet central passage 135 of the spool 111. The pressure of the fluid from supply S on the plate 119 is great enough to overcome the force of the spring 118 of the inlet check valve 123 and flow out to the retard chamber 103 through opening 118 between spool lands 111*b* and 111*c* and through ports 126 and 121 in fluid communication with the retard chamber 103.

Therefore, when the control valve 109 and the phaser are in this fifth mode, both cam torque actuation (fluid is recirculated from the advance chamber 102 to the retard chamber 103 through recirculation check valve 124) and torsion assist (fluid from supply S flows to the retard chamber 103 through an inlet check valve 123 and draining of fluid from the advance chamber to tank T) are simultaneously used to move the vane 104.

Since fluid is being supplied to the retard chamber 103 by the advance chamber 102 through recirculation, the pressure of the fluid on the lock pin 147 is great enough to overcome the force of the lock pin spring 148, and the lock pin 147 disengages the recess 146, allowing the housing assembly 101 to move relative to the rotor assembly 105.

By having a phaser which can operate in modes that use both TA and CTA to move the vane 104, the phaser can take advantage of the advantages that both TA and CTA offer. For example, CTA is most effective at low speeds, but has limited affect at high speeds and TA is most effective at high speeds. For a four cylinder engine, for example, the phaser may be placed in the second and fourth modes which use cam torque actuation only and fluid consumption is low since fluid is recirculated. The phaser may be placed in the first and fifth modes at high speed, which use cam torque and torsion assist, such that at high speeds oil pressure will compensate for any losses in cam torque energy.

FIGS. 11-16 show an alternate embodiment of the present invention. This embodiment differs from the phaser of FIGS. 1-10 since it only uses the second, third and fourth modes of FIGS. 1-10 and the lock pin is unlocked or locked based on spool position, since the lock pin is not in direct fluid communication with the either of the working chambers. The second, third, and fourth modes of the first embodiment have been renumbered to the first, second and third in the second embodiment.

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). As shown in the figures, vane phasers have a rotor assembly 205 with one or more vanes 204, mounted to the end of the camshaft, surrounded by a housing assembly 200 with the vane chambers into which the vanes fit. It is possible to have the vanes 204 mounted to the housing assembly 200, and the chambers in the rotor assembly 205, as well. The housing's outer circumference 201 forms the sprocket, pulley or gear accepting drive force through a chain, belt, or gears, usually from the crankshaft, or possible from another camshaft in a multiple-cam engine.

The housing assembly 200 of the phaser has an outer circumference 201 for accepting drive force. The rotor assembly 205 is connected to the camshaft (not shown) and is coaxially located within the housing assembly 200. The rotor assembly 205 has a vane 204 separating a chamber formed between the housing assembly 200 and the rotor assembly 205 into an advance chamber 202 and a retard chamber 203. The vane 204 is capable of rotation to shift the relative angular position of the housing assembly 200 and the rotor assembly 205. While only one advance chamber and one retard chamber are shown, multiple chambers may be present. Furthermore, in a phaser at least one set of advance and retard chambers are working or actively receiving or exhausting fluid and moving the vane.

A control valve 209, preferably a spool valve, includes a spool 211 with cylindrical lands 211*a*, 211*b*, 211*c*, 211*d*, 211*e* slideably received in a sleeve 214 within a bore 208 of a center bolt 210. The sleeve 214 has a plurality of ports 225, 226, 227, 229, 250, 252, 254, a first recess 256 which connects ports 252 and 254, and a second recess 228 which connects ports 226 and 229. The first recess 256 forms a passage 257 with the bore 208 of the center bolt 210, for fluid flow to and from the lock pin assembly 245. The second recess 228 forms a passage 239 with the bore 208 of the center bolt 210 for fluid to flow.

The center bolt 210 is preferably received by the camshaft (not shown). The center bolt 210 has a port 220 connected to the advance chamber 202 and in fluid communication with port 225 of the sleeve 214, a port 221 connected to the retard chamber 203 and in fluid communication with port 250 of the sleeve 214, a port 222 connected to the supply 242 and in fluid communication with port 227 of the sleeve 214 and port 260 connected to the lock pin assembly 245 via passage 244 and in fluid communication with port 252 of the sleeve 214.

The spool 211 has a working central passage 236 with a recirculation check valve 224 and an axial inlet passage 234 which is in fluid communication with an inlet check valve 223 through passage 235. The recirculation check valve 224 includes a plug 240, a plate 217, and a spring 216, with the first end of the spring 216 contacting the plug 240 and the second end contacting the plate 217. The inlet check valve 223 includes a plug 240, a ball 219, and a spring 218, with the first end of the spring 218 contacting the plug 240 and the second end contacting the ball 219. Between the first land 211*a* and the second land 211*b* is an opening 230 leading to the working central passage 236. Between the second land 211*b* and the third land 211*c* is an opening 231 leading to the recirculation check valve 224 and the inlet check valve 223. Between the third land 211*c* and the fourth land 211*d* is an annular groove 233. Between the fourth land 211*d* and the fifth land 211*e* is an opening 258 leading to the axial inlet passage 234.

One end of the spool 211 contacts spring 215 and the opposite end of the spool 211 contacts a pulse width modulated variable force solenoid (VFS) 207. The solenoid 207 may also be linearly controlled by varying current or voltage or other methods as applicable. Additionally, the opposite end of the spool 211 may contact and be influenced by a motor, or other actuators.

The position of the control valve 209 is controlled by an engine control unit (ECU) 206 which controls the duty cycle of the variable force solenoid 207. The ECU 206 preferably includes a central processing unit (CPU) which runs various computational processes for controlling the engine, memory, and input and output ports used to exchange data with external devices and sensors.

The position of the spool 211 is influenced by spring 215 and the solenoid 207 controlled by the ECU 206. Further detail regarding control of the phaser is discussed in detail below. The position of the spool 211 controls the mode of the phaser as well as whether the lock pin 247 is engaged or disengaged.

The control valve 209 has three modes. In the first mode, the spool 211 of the control valve 209 is positioned such that the vane 204 is moved by cam torque actuation in an advance direction. In the second mode, the spool 211 is positioned such that the vane 204 is moved by cam torque actuation in the retard direction. In the third mode, the spool 211 is positioned such that the vane 204 is held in position.

A lock pin assembly 245 is present within the phaser. A lock pin 247 is slideably housed in a bore in the rotor assembly 205 and has an end portion that is biased towards and fits into a recess 246 in the housing assembly 200 by a spring 248. Alternatively, the lock pin 247 may be housed in the housing assembly 200 and be spring 248 biased towards a recess 246 in the rotor assembly 205. The engagement and disengagement of the lock pin 247 with the recess 246 is controlled by a land 211*e* of the spool 211.

Cam torque actuation of a variable camshaft timing (VCT) of a phaser uses torque reversals in the camshaft caused by the forces of opening and closing engine valves to move the vane 204. The advance and retard chambers 202, 203 are arranged to resist positive and negative torque pulses in the camshaft (not shown) and are alternatively pressurized by the cam torque. The control valve 209 allows the vane 204 in the phaser to move by permitting fluid flow from the advance chamber 202 to the retard chamber 203 or vice versa, depending on the desired direction of movement.

FIGS. 11-16 show operating modes of a multi-mode VCT phaser depending on the spool valve position. The positions shown in the figures define the direction the VCT phaser is moving. It is understood that the phase control valve has an infinite number of intermediate positions, so that the control valve not only controls the direction the VCT phaser moves but, depending on the discrete spool position, controls the rate at which the VCT phaser changes positions. Therefore, it is understood that the phase control valve can also operate in infinite intermediate positions and is not limited to the positions shown in the Figures.

In the first mode, the spool 211 is moved to a position so that fluid may flow from the retard chamber 203, through the spool 211 and the recirculation check valve 224 within the spool 211, to the advance chamber 202. Fluid from a supply S provides fluid from the supply line 242 to the advance chamber 202 only through the spool 211 and the inlet check valve 223 within the spool 211 for makeup fluid only. The lock pin 247 is engaged with the recess 246 or is locked since fluid is prevented from entering the line 244 to the lock pin 245 from supply by spool land 211*e*.

In a second mode, the spool 211 is moved to a position so that fluid may flow from the advance chamber 202, through the spool 211 and the recirculation check valve 224 within the spool 211, to the retard chamber 203. Fluid from a supply S provides fluid to only the retard chamber 203 through the spool 211 and the inlet check valve 223 within the spool 211 for makeup fluid only. The lock pin 247 is disengaged from the recess 246 or is unlocked.

In a third mode, the spool 211 is moved to a position that blocks the exit of fluid from the advance and retard chambers 202, 203, but a small amount of fluid from supply S is able to enter the advance and retard chambers 202, 203 through the spool 111. The lock pin 247 is disengaged from the recess 246 or is unlocked.

Based on the duty cycle of the pulse width modulated variable force solenoid 207, the spool 211 moves to a corresponding position along its stroke, for example 0 mm stroke, 2.5 mm stroke, and 5 mm stroke. The duty cycle of the variable force solenoid 207 is varied to correspond to the specific position along its stroke.

Figure 11:
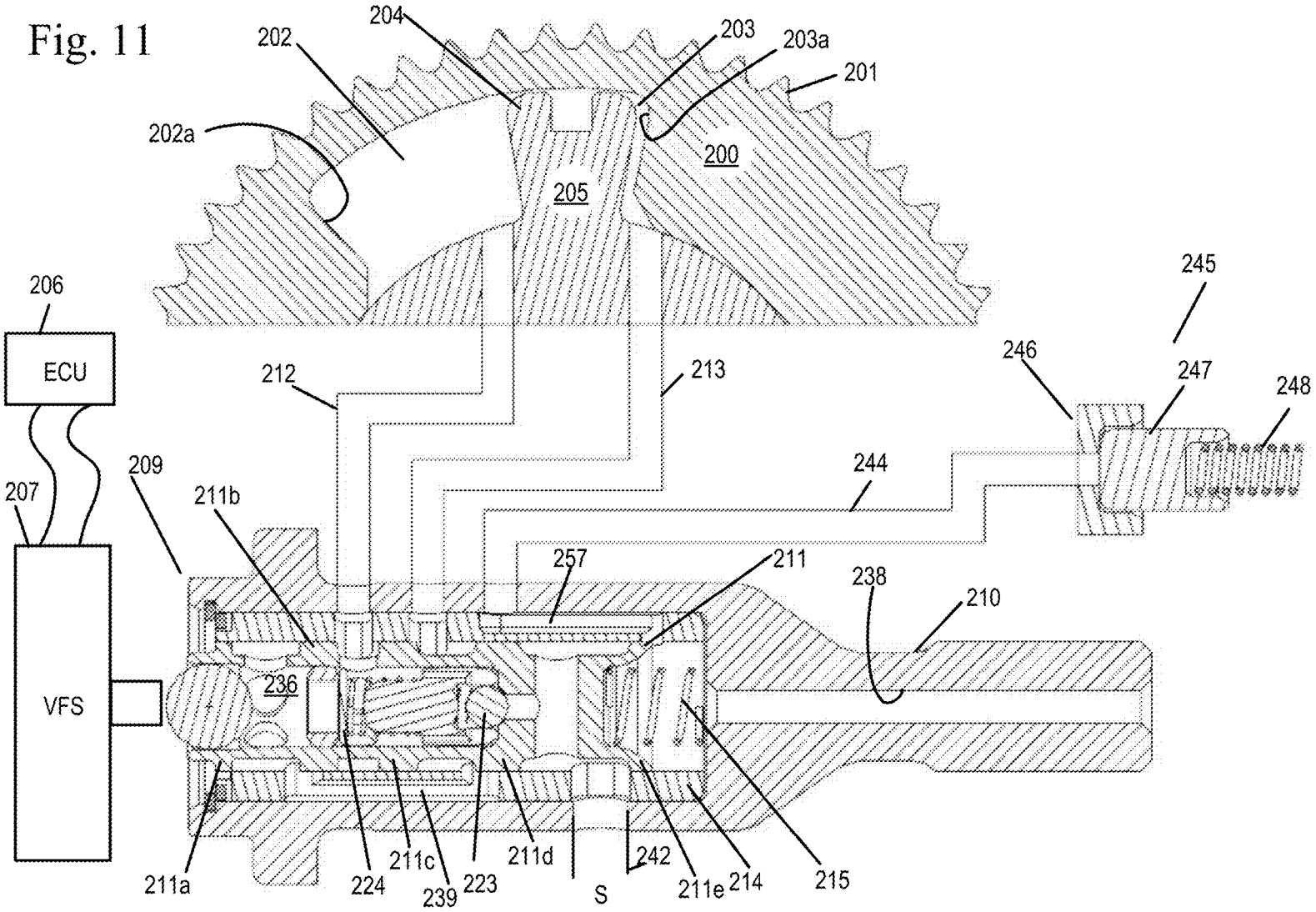
FIG. 11 shows a schematic of a variable cam timing phaser of an alternate embodiment operating in a first mode.
Figure 14:
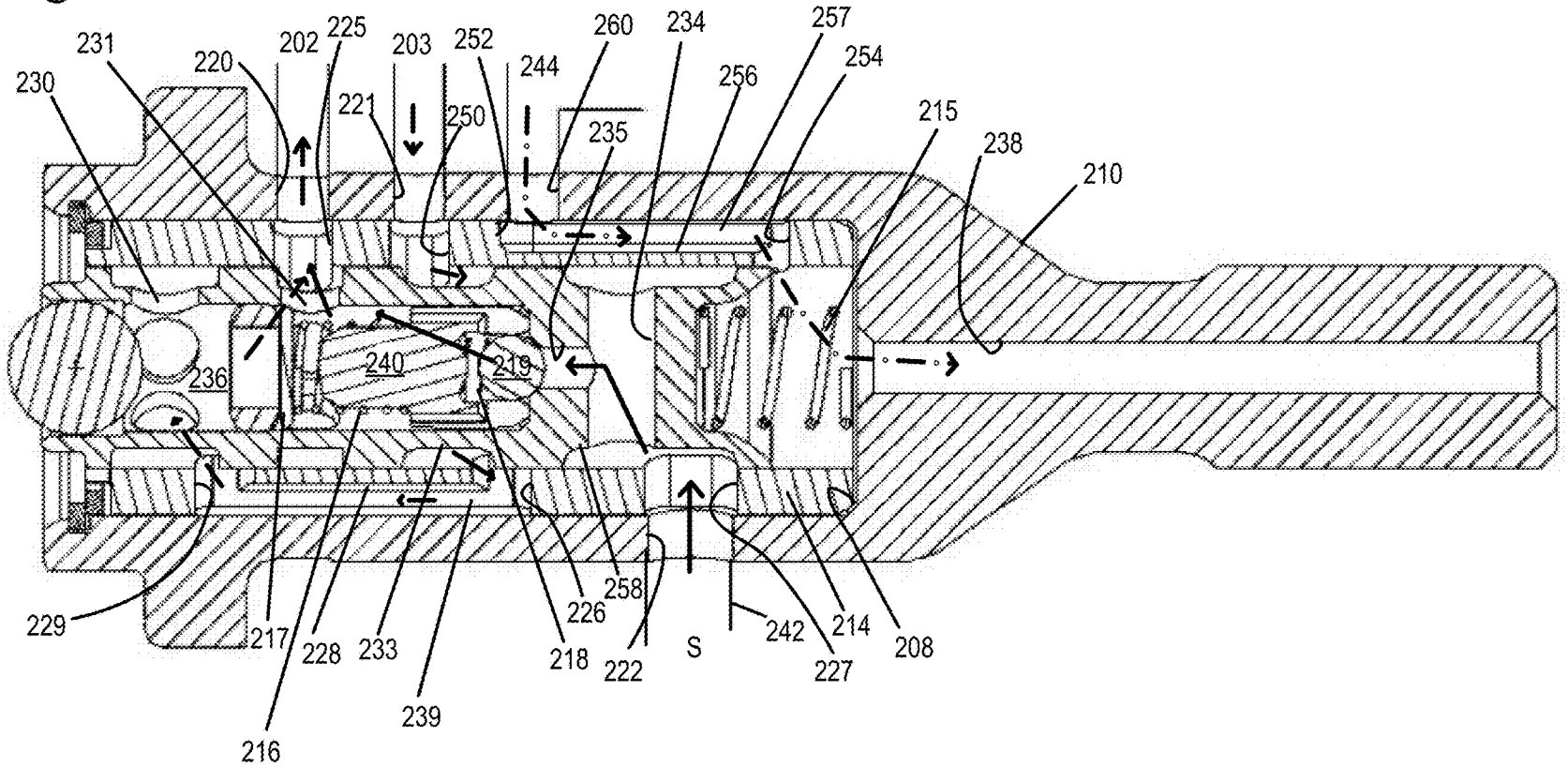
FIG. 14 shows a close-up of the control valve of the phaser of FIG. 11 operating in the first mode.

Referring to FIGS. 11 and 14, the phaser moving towards the advance position. To move towards the advance position, the duty cycle of the VFS 207 is such that the stroke of the spool 211 is 0 mm and the spool 211 is moved by the force of the spring 215 until the force of the spring 215 balances the force of the VFS 211.

Camshaft torque pressurizes the retard chamber 203, causing fluid to move from the retard chamber 203 and into the advance chamber 202, and the vane 204 to move towards the retard wall 203*a*.

With the position of the spool in the first mode, fluid from the retard chamber 203 (indicated by a dashed line in FIG. 14) flows through line 213 to the control valve 209. From line 213, fluid flows into the control valve through port 221 of the center bolt 210 and port 250 of the sleeve 214. From port 250, fluid flows around the annular groove 233 between spool lands 211*c* and 211*d* to the recess 228 and the passage 239 formed between the recess 228 of the sleeve 214 and the center bolt 210. From the passage 239, fluid can only recirculate to the advance chamber 202.

The fluid flowing to the advance chamber 202, flows from the passage 239, through port 229 of the sleeve 214 through an opening 230 between spool land 211*a* and 211*b* to a working central passage 236. The pressure of the fluid from the retard chamber 203 on the plate 217 is great enough to overcome the force of the spring 216 of the recirculation check valve 224 and flow out to the advance chamber 202 through opening 231 between spool lands 211*b* and 211*c* and through ports 225 and 220 in fluid communication with the advance chamber 202.

Fluid is also supplied to only the advance chamber 202 from a supply S to make up for leakage and is not used to move the vane 204. The supply S is in fluid communication with the ports 222 and 227 through supply line 242 (indicated by the solid line in FIG. 14). Fluid flows from the ports 222 and 227 to an axial passage 234 and passage 235 in the spool between spool lands 211*d* and 211*e*. The pressure of the fluid from supply S on the ball 219 is great enough to overcome the force of the spring 218 of the inlet check valve 223 and flow out to the advance chamber 202 through opening 231 between spool lands 211*b* and 211*c* and through ports 225 and 220 in fluid communication with the advance chamber 202.

Therefore, when the control valve 209 and the phaser are in this mode, only cam torque actuation (fluid is recirculated from the retard chamber 203 to the advance chamber 202 through check valve 224) is used to move the vane 204.

Fluid is not vented from the system. Hydraulic fluid is provided to the working chamber, which in this case is the advance chamber 202, from supply S to make up for leakage. When cam torque energy reverses, both the inlet check valve 223 and the recirculation check valve 224 prevent fluid from leaving the advance chamber 202 or working chamber.

Based on the position of the spool 211, fluid from supply S is prevented from providing fluid to line 244 by spool land 211*e* and the sleeve 214. Fluid from line 244 drains through passage 257 and passage 238 of the central bolt 210 to sump (not shown). The force of the lock pin spring 248 moves the lock pin 247, such that it engages the recess 246, locking the housing assembly 201 relative to the rotor assembly 205.

Figure 12:
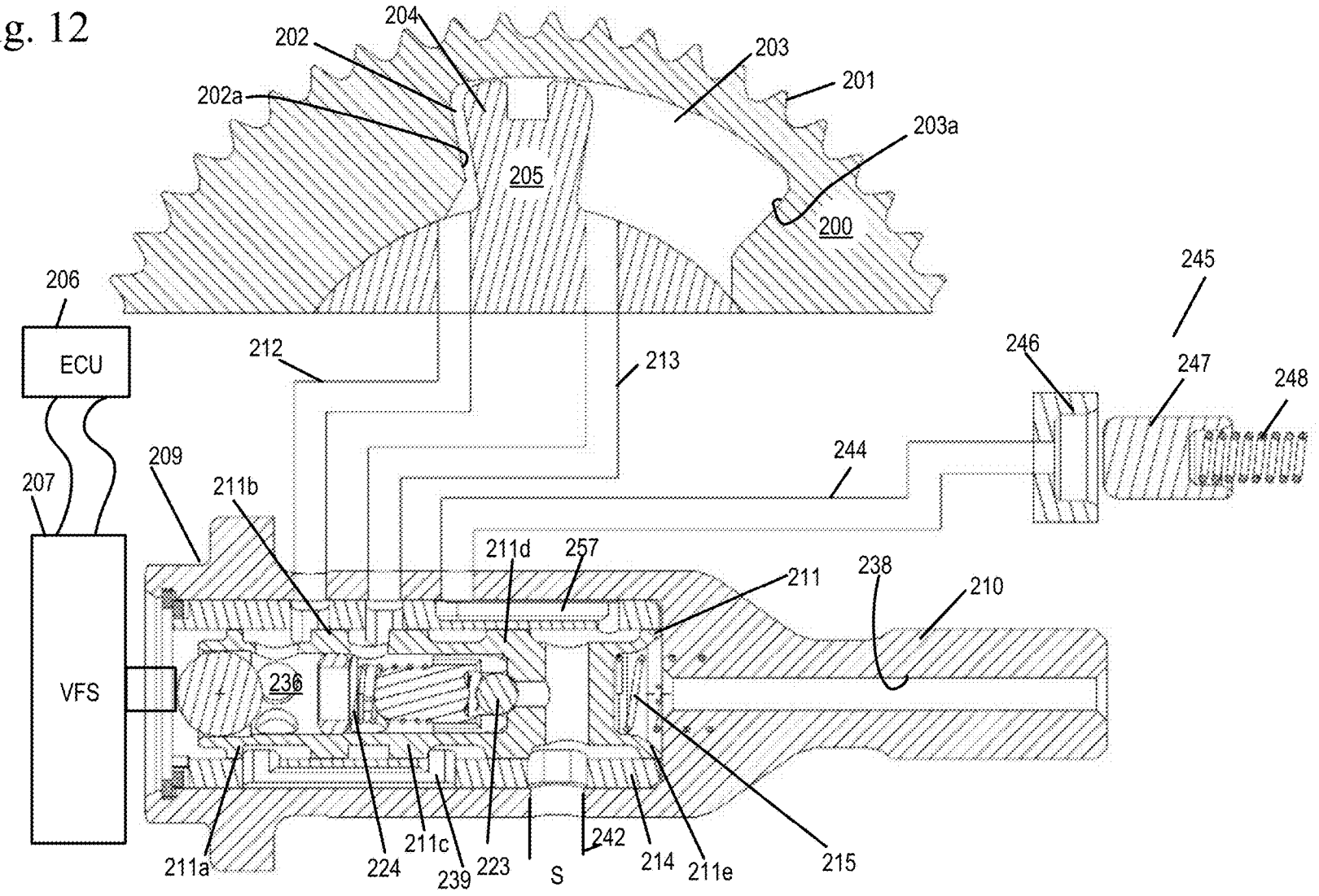
FIG. 12 shows a schematic of a variable cam timing phaser of an alternate embodiment operating in a second mode.
Figure 15:
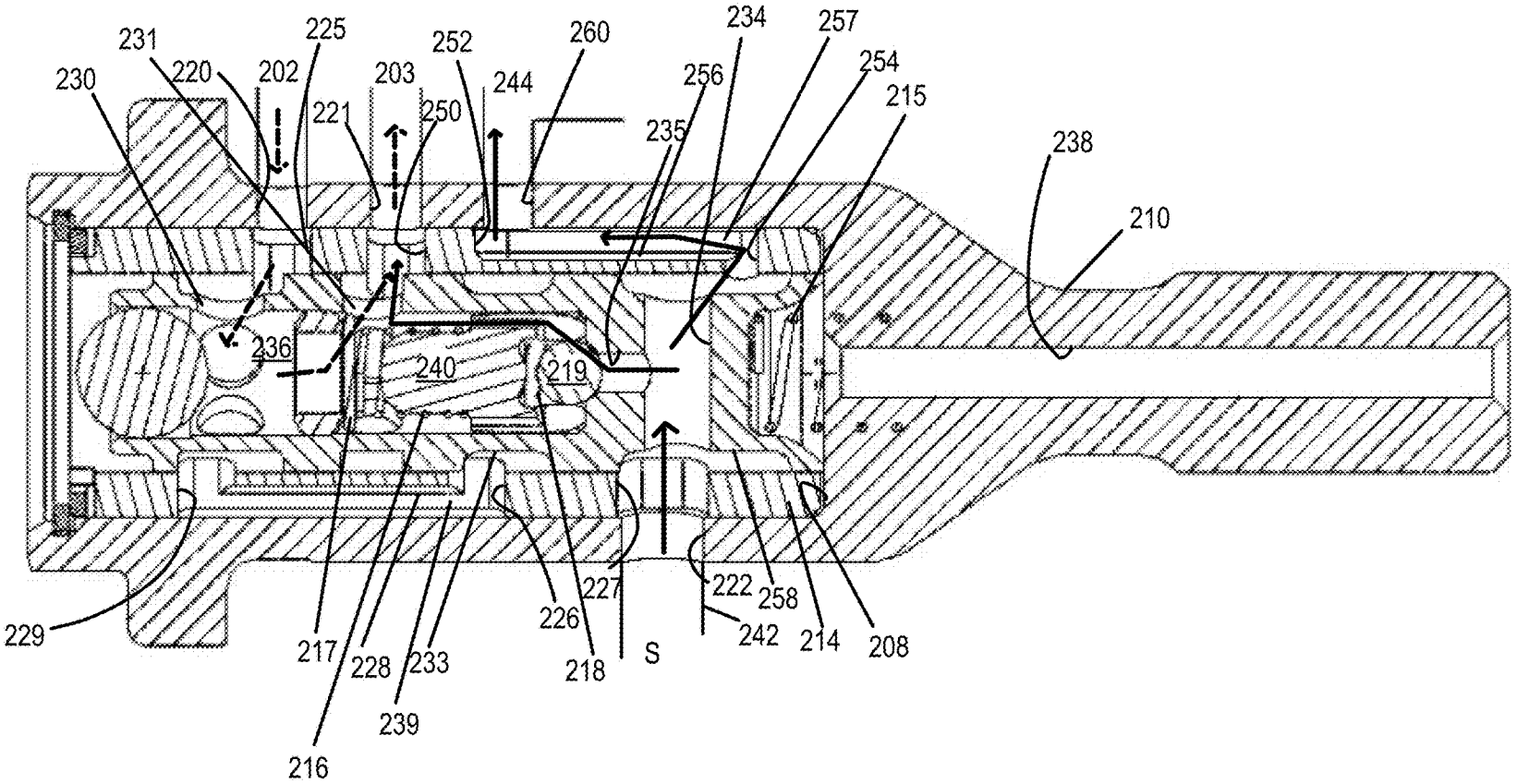
FIG. 15 shows a close-up of the control valve of the phaser of FIG. 12 operating in the second mode.

FIG. 12 shows the phaser moving towards the retard position and FIG. 15 shows a close up of the fluid flow through the control valve. To move towards the retard position, the duty cycle of the VFS 207 is such that the stroke of the spool 211 is 5 mm and the spool 211 is moved by the force of the VFS 207 until the force of the spring 215 balances the force of the VFS 211.

Camshaft torque pressurizes the advance chamber 202, causing fluid to move from the advance chamber 202 and into the retard chamber 203, and the vane 204 to move towards the advance wall 202*a*.

With the position of the spool in the second mode, fluid from the advance chamber 202 (indicated by a dashed line in FIG. 15) flows through line 212 to the control valve 209. From line 212, fluid flows into the control valve 209 through port 220 of the center bolt 210 and port 225 of the sleeve 214. From port 225, fluid flows into the working central passage 236 through an opening 230 between spool land 211*a* and 211*b*. The pressure of the fluid from the advance chamber 202 on the plate 217 is great enough to overcome the force of the spring 216 of the recirculation check valve 224 and flow out to the retard chamber 203 through opening 231 between spool lands 211*b* and 211*c* and through ports 250 and 221 in fluid communication with the retard chamber 203.

Fluid is also supplied to only the retard chamber 203 from a supply S to make up for leakage and is not used to move the vane 204. The supply S is in fluid communication with the ports 222 and 227 through supply line 242 (indicated by the solid line in FIG. 15). Fluid flows from the ports 222 and 227 to an axial passage 234 and passage 235 in the spool between spool lands 211*d* and 211*e*. The pressure of the fluid from supply S on the ball 219 is great enough to overcome the force of the spring 218 of the inlet check valve 223 and flow out to the retard chamber 203 through opening 231 between spool lands 211*b* and 211*c* and through ports 250 and 221 in fluid communication with the retard chamber 203.

Therefore, when the control valve 209 and the phaser are in this mode, only cam torque actuation (fluid is recirculated from the advance chamber 202 to the retard chamber 203 through check valve 224) is used to move the vane 204. Fluid is not vented from the system. Hydraulic fluid is provided to the working chamber, which in this case is the retard chamber 203, from supply S to make up for leakage. When cam torque energy reverses, both the inlet check valve 223 and the recirculation check valve 224 prevent fluid from leaving the retard chamber 203 or working chamber.

Based on the position of the spool 211, fluid from supply S provides fluid to line 244 through axial passage 234. From the axial passage 234, fluid flows through opening 258 between spool lands 211*d* and 211*e* to the first recess 256. Fluid flows in the passage 258 formed by the first recess 256 of the sleeve 214 and the bore 208 of the center bolt 210 to port 252 and port 260 leading to line 244. The force of the pressure of the fluid from supply S is greater than the force of the lock pin spring 248, and moves the lock pin 247, such that it disengages the recess 246, and the housing assembly 201 can move relative to the rotor assembly 205.

Figure 13:
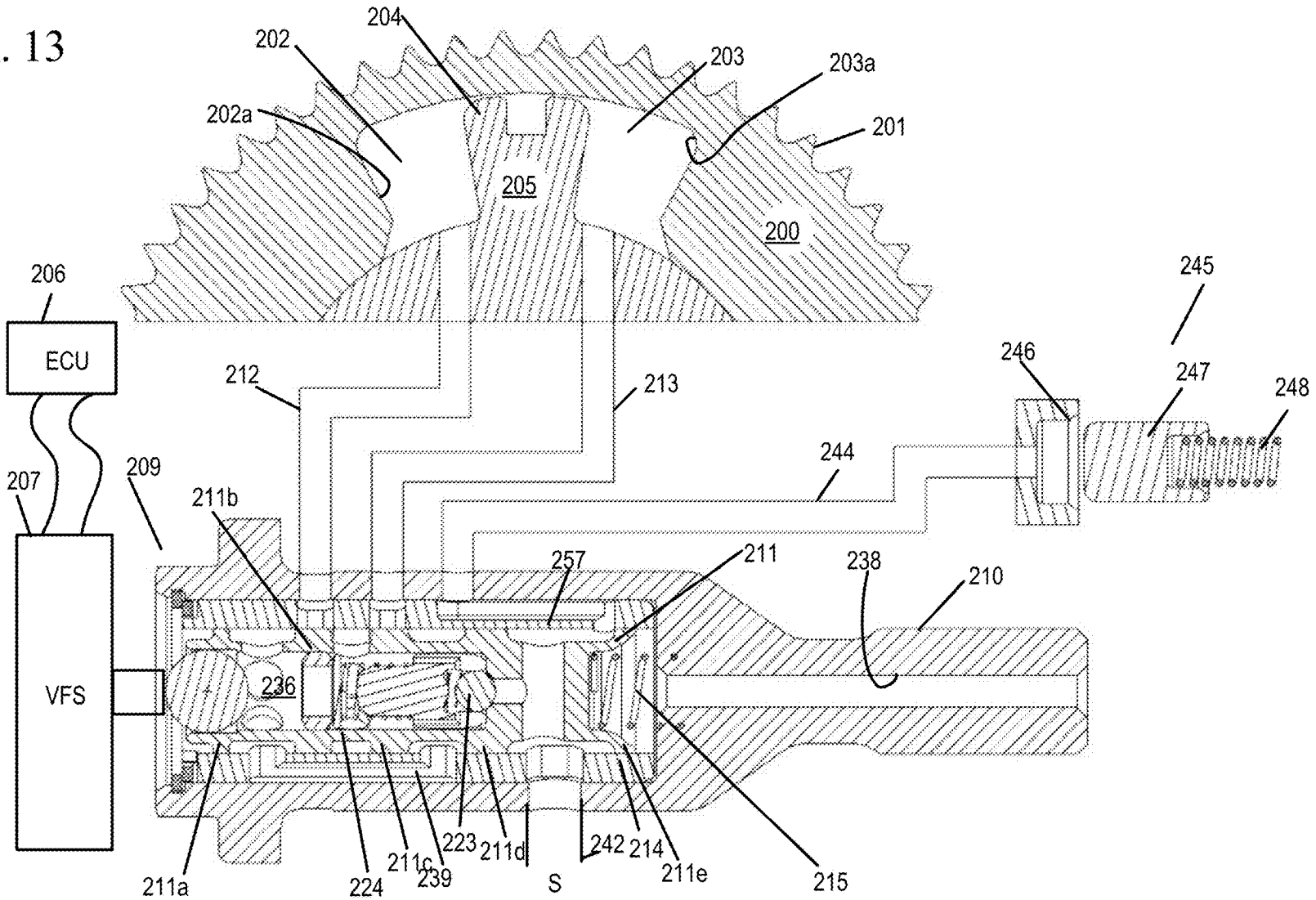
FIG. 13 shows a schematic of a variable cam timing phaser of an alternate embodiment operating in a third mode.
Figure 16:
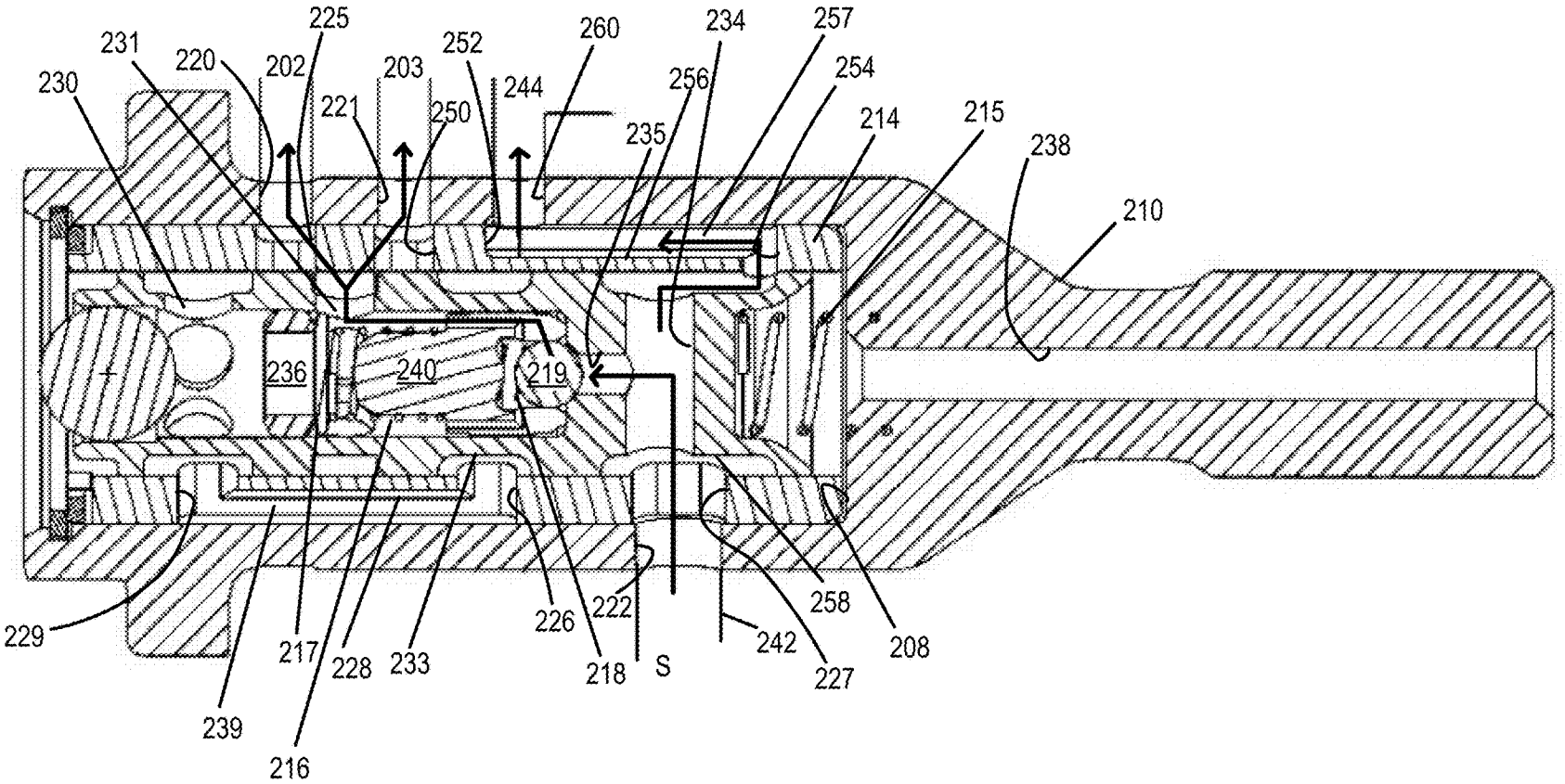
FIG. 16 shows a close-up of the control valve of the phaser of FIG. 13 operating in the third mode.

FIG. 13 shows the phaser in the null position and FIG. 16 shows a close up of the fluid flow through the control valve. In this position, the duty cycle of the variable force solenoid 207 is such that stroke of the spool is 2.5 mm. The force of the VFS 207 on one end of the spool 211 equals the force of the spring 215 on the opposite end of the spool 211 in null position.

With the position of the spool in the third mode, fluid from the supply S is provided to the advance chamber 202 and retard chamber 203 by ports 222 and 227 through supply line 242 (indicated by the solid line in FIG. 16). Fluid flows from the ports 222 and 227 to an axial passage 234 and passage 235 in the spool between spool lands 211*d* and 211*e*. The pressure of the fluid from supply S on the ball 219 is great enough to overcome the force of the spring 218 of the inlet check valve 223 and flow out to the retard chamber 203 through opening 231 between spool lands 211*b* and 211*c* and through ports 250 and 221 in fluid communication with the retard chamber 203 and to the advance chamber 202 through opening 231 through ports 225 and 220.

While the spool valve lands 211*b* and 211*c* appear to completely block off passage from the opening 231 to the ports 225, 220, 221, 250 leading to the advance and retard chambers 202, 203, there is a small undercut or gap to allow fluid to flow to the advance and retard chambers 202, 203.

Based on the position of the spool 211, fluid from supply S provides fluid to line 244 from axial passage 234. From the axial passage 234, fluid flows through opening 258 between spool lands 211*d* and 211*e* to the first recess 256. Fluid flows in the passage 257 formed by the first recess 256 of the sleeve 214 and the bore 208 of the center bolt 210 to port 252 and 260 leading to line 244. The force of the pressure of the fluid from supply S is greater than the force of the lock pin spring 248, and moves the lock pin 247, such that it disengages the recess 246, and the housing assembly 201 can move relative to the rotor assembly 205.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser for an internal combustion engine including a housing assembly with an outer circumference for accepting drive force and a rotor assembly having at least one vane, the rotor assembly being coaxially located within the housing for connection to a camshaft, wherein the housing assembly and the rotor assembly define at least vane chamber separated by a vane into an opposing first chamber and second chamber, the vane within the vane chamber acting to shift relative angular position of the housing assembly and the rotor assembly when fluid is supplied to the first chamber or the second chamber, the phaser comprising:

a control valve for directing fluid from a fluid input to and from the first chamber and second chamber through a first chamber line, a second chamber line, a supply line coupled to the fluid input, and at least one exhaust passage connected to sump, the control valve comprising:

a hollow sleeve with a plurality of ports, with at least two of the ports are connected by a recess;

a spool received within the hollow sleeve comprising:

a plurality of lands for selectively blocking the plurality of ports of the hollow sleeve;

a central passage located within the spool;

an inlet central passage located within the spool;

a recirculation check valve received within the central passage, limiting the flow of fluid between the first and second chambers through the central passage;

an inlet check valve received within the inlet central passage, allowing fluid from the fluid input to flow to the first and second chambers, and preventing flow from the first and second chambers to the fluid input during cam torque reversals;

the control valve being movable between positions wherein the phaser operates in a plurality of modes under control of the control valve, the modes comprising:

a first mode using cam torque and torsion assist hydraulic pressure to move the vane in a first direction, in which fluid from the first chamber is exhausted through the exhaust passage to the sump from the recess, with the fluid being exhausted from the second chamber and also recirculating to the first chamber through the recirculation check valve, and fluid is also supplied from the fluid input to one of the chambers through the inlet check valve of the spool;

a second mode using cam torque to move the vane in a first direction, in which fluid is recirculated between the first and second chambers through the recirculation check valve of the spool and makeup fluid is supplied from the fluid input to the first chamber through the inlet check valve of the spool;

a third mode for holding the phaser in position, in which fluid is routed to the first and second chambers from the fluid input through the inlet check valve of the spool;

a fourth mode using cam torque to move the vane in a second direction, in which fluid is recirculated between the first and second chambers through the recirculation check valve of the spool and makeup fluid is supplied from the fluid input to the second chamber through the inlet check valve of the spool;

a fifth mode using cam torque and torsion assist hydraulic pressure to move the vane in a second direction, in which fluid from the first chamber is exhausted through the exhaust passage to sump from the recess, with the fluid being exhausted also being recirculating to the second chamber through recirculation check valve and fluid is also supplied from the fluid input to the second chamber through the inlet check valve of the spool.

2. The phaser of claim 1, wherein the control valve further comprises a hollow center bolt with a bore for receiving the sleeve and the spool.

3. The phaser of claim 2, wherein the recess and the bore of center bolt form an exhaust passage between ports of the sleeve leading to the sump.

4. The phaser of claim 1, wherein recirculation check valve comprises a plate, a plug, and a spring with a first end contacting the plate and a second end contacting to the plug.

5. The phaser of claim 1, wherein the inlet check valve comprises a plate, a plug, and a spring with a first end contacting to the plate and a second end contacting to the plug.

6. The phaser of claim 1, wherein in the second mode, third mode, and fourth mode, an interface between a land of the spool and the sleeve blocks the flow of fluid to the sump.

7. The phaser of claim 1, further comprising a lock pin slideably located in the rotor assembly or the housing assembly, the lock pin being moveable by fluid provided to the first chamber or the second chamber from a locked position in which an end portion engages a recess, locking the relative angular position of the housing assembly and the rotor assembly, to an unlocked position in which the end portion does not engage the recess;

wherein when the control valve is in the position for the first mode, the lock pin is moved to the locked position;

wherein when the control valve is not in the position for the first mode, the lock pin is moved to the unlocked position.

8. The phaser of claim 1, wherein the first chamber is an advance chamber and the second chamber is a retard chamber.

9. The phaser of claim 1, wherein the first chamber is a retard chamber and the second chamber is an advance chamber.

* * * * *